US008201906B2

(12) United States Patent
Scardovi et al.

(10) Patent No.: US 8,201,906 B2
(45) Date of Patent: Jun. 19, 2012

(54) INK-JET PRINTING METHOD AND INK-JET PRINTING SYSTEM FOR MULTI-DEFINITION PRINTING

(75) Inventors: Alessandro Scardovi, Ivrea (IT); Patrick Rapin, Grandcour (CH); Walter Cerutti, Arnad (IT)

(73) Assignee: Telecom Italia S.p.A., Milan (IT)

( * ) Notice: Subject to any disclaimer, the term of this patent is extended or adjusted under 35 U.S.C. 154(b) by 494 days.

(21) Appl. No.: 11/921,867

(22) PCT Filed: Jun. 9, 2005

(86) PCT No.: PCT/EP2005/006210

§ 371 (c)(1),
(2), (4) Date: Jun. 14, 2010

(87) PCT Pub. No.: WO2006/131137

PCT Pub. Date: Dec. 14, 2006

(65) Prior Publication Data

US 2010/0245426 A1 Sep. 30, 2010

(51) Int. Cl.
*B41J 29/38* (2006.01)

(52) U.S. Cl. ..... 347/12

(58) Field of Classification Search ..... 347/12
See application file for complete search history.

(56) References Cited

U.S. PATENT DOCUMENTS

| | | | | |
|---|---|---|---|---|
| 5,907,331 | A | 5/1999 | Markham | |
| 6,273,548 | B1 | 8/2001 | Gruner et al. | |
| 6,318,828 | B1 | 11/2001 | Barbour et al. | |
| 6,478,396 | B1 | 11/2002 | Schloeman et al. | |
| 6,582,041 | B1 * | 6/2003 | Tsuruoka | 347/12 |
| 6,669,330 | B2 | 12/2003 | Vanhooydonck et al. | |
| 6,851,791 | B2 | 2/2005 | Conta et al. | |
| 6,902,252 | B1 | 6/2005 | Torgerson et al. | |
| 2002/0067392 | A1 * | 6/2002 | Alfaro | 347/41 |
| 2003/0210292 | A1 * | 11/2003 | Vanhooydonck et al. | 347/12 |
| 2004/0032447 | A1 * | 2/2004 | Serra et al. | 347/37 |
| 2006/0268056 | A1 * | 11/2006 | Molinet et al. | 347/12 |

FOREIGN PATENT DOCUMENTS

EP 1 361 068 A1 11/2003

OTHER PUBLICATIONS

International Search Report dated Mar. 27, 2006 issued in PCT/EP2005/006210.

* cited by examiner

*Primary Examiner* — Shelby Fidler
(74) *Attorney, Agent, or Firm* — Venable LLP; Robert Kinberg; Steven J. Schwarz

(57) ABSTRACT

The present invention relates to a method of addressing the nozzles of a printhead; a group of nozzles of a print column of the printhead are staggered and are arranged according to a spatial order, e.g. N01 N02 N03 N04 N05 N06 N07 N08 N09 N10 N11 N12, with respect to the transversal translation direction of the printhead; the nozzle of the group are divided in a number, e.g. 2 or 3 or 4 or 5, of sequential subgroups corresponding to different addressing spaces; an addressing scheme is obtained by cyclically and progressively selecting addresses from these addressing spaces; in this way, it is possible to print with a single pass at different resolutions, higher than the standard resolution of the printhead, by reducing the transversal translation speed of the printhead but maintaining the same addressing timing; the method according to the present invention leaves the possibility of printing at standard resolution and at lower resolutions.

16 Claims, 5 Drawing Sheets

INK-JET PRINTING METHOD AND INK-JET PRINTING SYSTEM FOR MULTI-DEFINITION PRINTING

FIELD OF THE INVENTION

The present invention relates to a method of addressing the nozzles of a printhead, particularly an inkjet printhead.

BACKGROUND OF THE INVENTION

As it is well known, an inkjet printhead is able to generate a plurality of dots on a print medium, the nozzles being the elements that are able to generate single dots on the print medium by ejecting ink drops. Typically, the printhead ejects the ink drops through the nozzles by rapidly heating a small volume of ink located in vaporization chambers with small electric heaters, such as thin film resistors. Heating the ink causes the ink to vaporize and be ejected from the nozzles (also known as "firing").

An inkjet printer produces a printed image by printing a pattern of individual dots (or pixels) at specific locations of an array. These dot locations are defined by the pattern to be printed. In order to produce a printed image through a printer, the printhead is mounted on a carriage that is moved transversally to the print medium and the print medium is moved longitudinally, i.e. perpendicularly to the translation direction of the carriage and of the printhead; therefore, the printhead is designed for having a specific transversal translation direction. In most printers, in order to reduce the print time, the printhead prints, i.e. its nozzles eject ink drops, when the carriage moves in a first direction, e.g. from left to right, as well as when the carriage moves in a second direction opposite to the first direction, e.g. from right to left.

An ink supply, such as an ink reservoir, supplies ink to the nozzles and a control unit controls the ejection of ink drops from the nozzles, i.e. the firing of the nozzles, according to the patterns to be printed.

The nozzles of a printhead are usually grouped in one or more vertical print columns adjacent to each other in the transversal direction.

U.S. Pat. No. 6,478,396 discloses a printhead including a group of nozzles and a group of firing resistors corresponding to the group of nozzles. The printhead includes a programmable nozzle firing order controller configured to provide address generator control signals; various nozzle address sequences are provided based on a skipping approach.

U.S. Pat. No. 6,318,828 discloses a printhead assembly that controls the firing operations of the printhead. A detailed structural and functional description is provided of a printing system, a printhead assembly and a printhead.

Inkjet ejectors (nozzles) can be arranged in different layouts in the print column. As described in U.S. Pat. No. 5,907,331, activating an array of ejectors in their natural order may result in droplets emitted in neighbouring ejectors splashing against each other, thus resulting in undesirable print defects. A different order will ensure that an ejector to be activated is a number of ejectors away from the previous ejector that was activated.

As in practice it is difficult to manufacture a printhead where many nozzles would fire at the same time, it is common to divide each print column of a printhead into print groups of nozzles and to stagger the nozzles of each print group along the transversal direction and to fire only one nozzle per print group at the same time; usually a constant pitch is used. Since in each group the nozzles are located at different positions along the transversal direction, in order to produce a vertical line through the print column, it is necessary to address the nozzles sequentially, according to a suitable timing. Said timing depends among other things on the translation speed of the printhead in the transversal direction. In a printhead comprising groups of staggered nozzles, for each group a staggering width is defined corresponding to the number of nozzles in the group multiplied by the pitch; in other terms, the staggering width corresponds substantially to the distance between the first nozzle in the transversal direction and the last nozzle in the transversal direction. Therefore, a staggered nozzles printhead is associated to an intrinsic transversal printing resolution, i.e. its staggering width, which can be defined as its standard or normal transversal printing resolution.

From U.S. Pat. No. 6,669,330, it is known a method for printing through one staggered nozzles printhead with resolutions that differ from the standard resolution of the printhead. The speed in the transversal direction is changed with reference to a reference velocity, which the printhead is intended to be driven with, while preferably keeping the firing frequency of its nozzles unchanged. The firing order of the nozzles may or may not be changed.

The Applicant has considered the technical teaching of this document and has realized that each print group in the print column is divided vertically into a number N of adjacent and identical staggered sets each of a number M of nozzles, that only two firing orders are used for printing, that is to say the direct order e.g. ABC or ABCD and the reverse order e.g. CBA or DCBA, and that the possible resolutions that can be obtained are the following multiples of the standard resolution:

M i+1,

M i−1.

The Applicant has understood that, in practice, according to the teaching of this document, in order to have many small multiples, e.g. 2 3 4 5 6 7 8 9 . . . , of the standard resolution, which would be desirable, M must be either 3 or 4; if M=3 the multiples are 2 4 5 7 8 . . . ; if M=4, the multiples are 3 5 7 9 . . . .

According to the teaching of this document, N nozzles fires at the same time in the same group of the same print column. As already said, the Applicant has noted that this would be difficult to realize and would require that the total number T of nozzles of the group of the print column be very small; for example, if N=2 and M=3 T=2×3=6, or, if N=2 and M=4 T=2×4=8. Anyway, according to the Applicant's knowledge and experience, in practical applications the print groups of a print column comprise at least 10 nozzles each, preferably more.

It is an object of the present invention to provide a method of addressing the nozzles of a staggered printhead whereby different print resolutions may be obtained with a single pass of the printhead without the limitations and constraints of the methods according to the prior art.

This object is achieved through the teaching of the present invention.

SUMMARY OF THE INVENTION

A main aim of the present invention is to achieve a higher resolution than the standard resolution by reducing the translation speed the printhead, while maintaining the addressing frequency of the nozzles of the printhead. The object of the invention is achieved by choosing an addressing order of the nozzles of the printhead such as to produce on the print medium a number of staggered pattern sections smaller than the line corresponding to a whole print column.

In this way, a whole line is produced in a number of consecutive print phases.

Advantageously, the addressing method according to the present invention can be implemented on any existing printhead independently from the number of its nozzles.

Additionally, theoretically any resolution may be achieved that is a multiple of the standard resolution of the printhead.

Advantageously, the method of addressing the nozzles of a printhead according to the invention allows to print at multiple print resolutions in only one pass.

The present invention will be more apparent from the following description to be considered in conjunction with the accompanied drawings, in which:

DETAILED DESCRIPTION OF THE INVENTION

The present invention will be explained through two non limiting examples.

Figure 1:
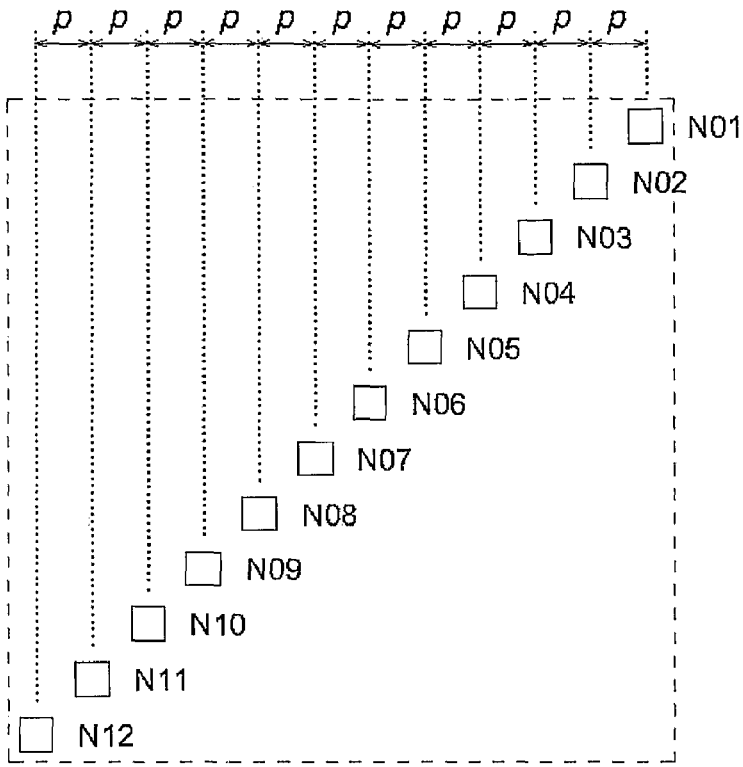
FIG. 1 shows the layout of the nozzles of a group in a first printhead.
Figures 1, 3:
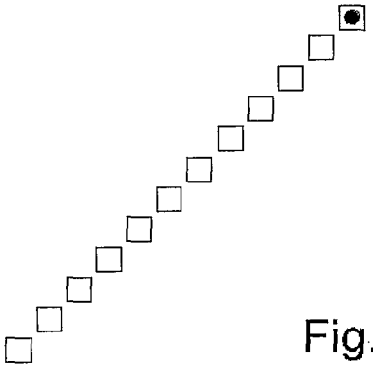
FIG. 3 shows a print sequence of the group of FIG. 1 at standard resolution.
Figures 2, 3:
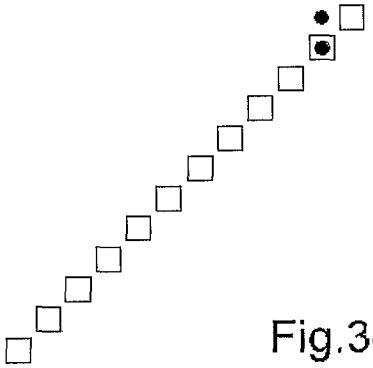
Figure 3:
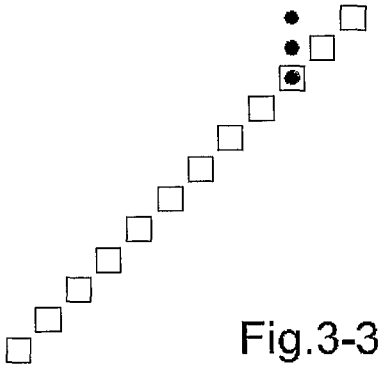
Figures 3, 4:
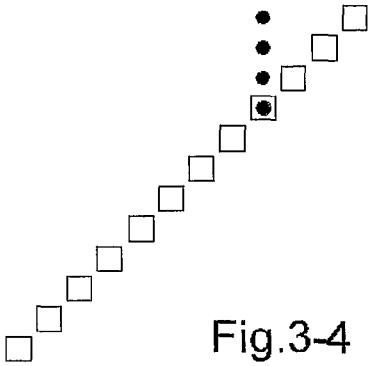
FIG. 4 shows a print sequence of the group of FIG. 1 at double resolution.

In the first example, the printhead is provided with at least one print column comprising print groups made of twelve staggered nozzles; the figures to be considered are FIG. 1, FIG. 3 and FIG. 4.

Figure 2:
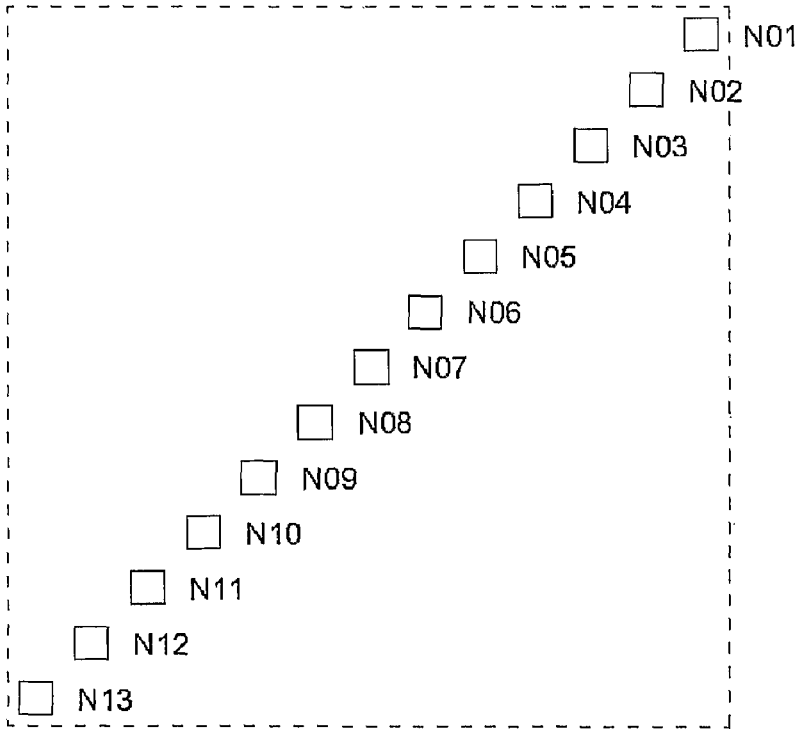
FIG. 2 shows the layout of the nozzles of a group in a second printhead.

In the second example, the printhead is provided with at least one print column comprising print groups made of thirteen staggered nozzles; the figure to be considered is FIG. 2.

First Example

In the first example, the standard resolution is 300 dpi [dot per inch]; the nozzles of the print group are staggered according to the maximum staggering width compatible with the standard resolution, i.e. 25400 μm/300 dpi=about 84 μm. The pitch "p" of the nozzles corresponds to 84 μm/12 nozzles=about 7 μm.

In the example of FIG. 1, the nozzles are staggered and arranged according to a spatial order with respect to a transversal translation direction of the printhead; specifically, the top nozzle N01 of the print group is the first according the specific spatial order of FIG. 1 and the bottom nozzle N12 of the print group of the printhead is the last according to the specific spatial order of FIG. 1.

According to the construction of a printhead, there is a maximum nozzle firing frequency; in other terms, it takes some time to generate an ink drop, to eject the ink drop and to be ready to start a new generation of an ink drop from the same nozzle. The time period associated to the maximum firing frequency will be hereafter referred to as the "firing interval", whereas the time elapsed between two consecutive ejections from different nozzles, which correspond in FIG. 1 for example to the time between the firing of nozzle N01 and of nozzle N02, will be referred to as the delay.

For example, if the maximum nozzle firing frequency is 12 KHz, the "firing interval" is about 84 μs, i.e. the period between two consecutives ejections from the same nozzle should be at least of about 84 μs. In this case, the maximum translation speed of the printhead in the transversal direction at standard resolution is 84 μm/84 μs=1 μm/μs=1 m/s; of course, a lower speed may be used.

For printing at standard resolution, the nozzles of the printhead will be addressed cyclically according to their spatial order; i.e. N01, N02, N03, N04, N05, N06, N07, N08, N09, N10, N11, N12, and then again N01, N02, N03, . . . .

If the pattern to be printed is a vertical line and the above mentioned maximum translation speed is used, at first nozzle N01 is addressed and fires (FIG. 3-1), after 7 μs nozzle N02 is addressed and fires (FIG. 3-2), after 7 is nozzle N03 is addressed and fires (FIG. 3-3), after 7 μs nozzle N04 is addressed and fires (FIG. 3-4), after 7 μs nozzle N05 is addressed and fires (FIG. 3-5), after 7 μs nozzle N06 is addressed and fires (FIG. 3-6), after 7 μs nozzle N07 is addressed and fires (FIG. 3-7), after 7 μs nozzle N08 is addressed and fires (FIG. 3-8), after 7 μs nozzle N09 is addressed and fires (FIG. 3-9), after 7 μs nozzle N10 is addressed and fires (FIG. 3-10), after 7 μs nozzle N11 is addressed and fires (FIG. 3-11), after 7 μs nozzle N12 is addressed and fires (FIG. 3-12). The sequence is shown through the first twelve views of FIG. 3 where both the nozzles of the printhead and the printed dots are schematically depicted.

After that, the printhead is ready to print a new pattern at a distance of 84 μm from the already printed pattern, corresponding to a resolution of 300 dpi, i.e. the standard resolution in this example.

If the new pattern is a vertical line and the maximum translation speed is used, at first nozzle N01 is addressed and fires (FIG. 3-13), after 7 μs nozzle N02 is addressed and fires (FIG. 3-14), after 7 μs nozzle N03 is addressed and fires (FIG. 3-15), after 7 μs nozzle N04 is addressed and fires (FIG. 3-16), and so on till nozzle N12. The described sequence is shown through the final four views of FIG. 3.

If a print resolution lower than the standard resolution is desired (hereafter referred also to as the draft resolution), a first possibility would be to use the same translation speed as that of the standard resolution, to carry out the first twelve nozzle addressing steps as in the case of the standard resolution, i.e. with the same addressing timing, and to add a delay before starting a new addressing cycle. For example, if a 150 dpi resolution is desired, after addressing nozzle N12 a delay of 84 μs, corresponding to a printhead shift of 84 μm, is introduced before addressing nozzle N01 again; therefore the distance between two consecutive patterns will be 168 μm, corresponding to a resolution of 150 dpi, as desired. In this case, the nozzle firing frequency is halved with respect to nozzle firing frequency at standard resolution and, even if the print quality is reduced, the print speed is not increased.

If a print resolution lower than the standard resolution is desired, a second possibility would be to use a higher translation speed and to carry out the nozzle addressing with a different addressing timing; this second possibility has the advantage that the print speed is increased. For example, if a 150 dpi resolution is desired, the translation speed is 2 μm/μs=2 m/s; the nozzles of the printhead are addressed from N01 to N12 with a delay of 3.5 μs and then a delay of 42 μs, corresponding to a printhead shift of 84 μm, is introduced before addressing nozzle N01 again. Therefore, the distance between two consecutive patterns will be 168 μm, corresponding to a resolution of 150 dpi, as desired. In this case, the nozzle firing frequency is the same as the nozzle firing frequency at standard resolution. However, in order to prevent or minimize misalignment of the printed dots in the printing line, the nozzle firing frequency should preferably be such that the half of the corresponding firing period is not smaller than the sum of the durations of the firing pulses of all the nozzles.

According to the invention, with the printhead of FIG. 1 it is possible to print at five different resolutions higher than the standard resolution, namely with resolutions being 2 times, 3 times, 4 times, 6 times and 12 times the standard resolution; specifically, if the standard resolutions is 300 dpi, it is possible to print at 600 dpi, 900 dpi, 1200 dpi, 1800 dpi and 3600 dpi. The above mentioned resolutions are multiples of the standard resolution; the multiplying factor is a divisor of the total number of nozzles in the print group, i.e. 12 in FIG. 1.

The sequence shown in FIG. 4, where both the nozzles of the printhead and the printed dots are shown, refers to the operation at 600 dpi.

For printing at double resolution, i.e. 600 dpi, the transversal translation speed of the printhead is halved, i.e. 0.5 μm/μs=0.5 m/s. If patterns to be printed are vertical lines, at first nozzle N01 is addressed and fires (FIG. 4-1), after 7 μs nozzle N07 is addressed and fires (FIG. 4-2), after 7 μs nozzle N02 is addressed and fires (FIG. 4-3), after 7 μs nozzle N08 is addressed and fires (FIG. 4-4), after 7 μs nozzle N03 is addressed and fires (FIG. 4-5), after 7 μs nozzle N09 is addressed and fires (FIG. 4-6), after 7 μs nozzle N04 is addressed and fires, after 7 μs nozzle N10 is addressed and fires, after 7 μs nozzle N05 is addressed and fires, after 7 μs nozzle N11 is addressed and fires, after 7 μs nozzle N06 is addressed and fires, after 7 μs nozzle N12 is addressed and fires. Part of this sequence is shown through the first six views of FIG. 4 where both the nozzles of the printhead and the printed dots are shown. It is apparent that with the described sequence, two pattern sections belonging respectively to two different patterns are printed on the print medium: the upper part of the pattern on the right (in FIG. 4) and the lower part of the pattern on the left (in FIG. 4). The distance between the two pattern sections is about 42 μm (actually 38.5 μm) corresponding to a resolution of 600 dpi, as desired.

After that, the printhead is ready to print two new pattern sections respectively at a distance of 42 μm from the already printed pattern, corresponding to a resolution of 600 dpi, as desired.

FIG. 4-7 shows the printed dots after nineteen addressing and firing steps at 600 dpi resolution. In the example depicted in FIGS. 4-7, the lower section of the central pattern is slightly misaligned with respect to the upper section of the central pattern.

Although this error is evident in the figure, this is not true in reality as the figure is much enlarged in the horizontal direction.

At higher resolutions such a misalignment would lead to an error in the slope, i.e. vertical patterns would be printed not perfectly vertically aligned.

The present invention may be defined in broader terms; in the following this will be done with the help of FIGS. 1 and 4.

The method according to the present invention is to be used for addressing a group of a first number K of nozzles of a printhead; such group of nozzles is typically a print group in the print column of a printhead, like in the examples of FIG. 1 and FIG. 2; in the example of FIG. 1 the first number K is "12" and in the example of FIG. 2 the first number K is "13". The nozzles of said group are staggered and are arranged according to a spatial order with respect to the transversal translation direction of the printhead according to a first direction, which in FIG. 1 and FIG. 2 it is assumed to be from left to right, according to a first direction of transversal translation. Each nozzle of said group has an own unique address; for the sake of simplicity, it will be assumed that the address corresponds to the label used till now to identify the nozzle, i.e. N01, N02, . . . .

In general, the method according to the present invention comprises the steps of:

A) dividing the group of nozzles into a second number L of sequential subgroups of nozzles, corresponding to a second number L of addressing spaces, said addressing spaces consisting of a same third number M of addresses, wherein the first of said addressing spaces comprises the address of the first nozzle in said spatial order, B) preparing an addressing scheme by cyclically and progressively selecting addresses from said addressing spaces, starting from the address corresponding to the first nozzle in said spatial order and following said spatial order, C) when the printhead translates transversally in said first direction, addressing the nozzles of the group according to the addressing scheme of step B.

The first number K, the second number L and the third number M are integers, the second number L is not greater than the first number K, and the third number M is the integer equal to the quotient between said the number K and the second number M.

The timing associated to the addressing scheme of step B) is herein referred also to as addressing timing.

The second number L is preferably selected to be the multiplying factor between the standard resolution and a desired higher resolution. For example, if the standard resolution is 300 dpi and a higher resolution of 600 dpi is desired, L is selected to be "2".

This general definition will be applied to the printhead of FIG. 1 in the following five different cases.

Case 1

In FIG. 1, the first number K is "12", the second number L is "2" and the third number M is "6"=12/2; the a first subgroup of nozzles comprises nozzles N01, N02, N03, N04, N05, N06; the second group of nozzles comprises nozzles N07, N08, N09, N10, N11, N12; the addressing scheme according to step B is obtained by:

selecting the first address from the first space (i.e. N01), selecting the first address from the second space (i.e. N07), selecting the second address from the first space (i.e. N02), selecting the second address from the second space (i.e. N08), selecting the third address from the first space (i.e. N03), and so on till N12 when the cycle is repeated starting from address N01.

This addressing scheme can be understood better considering the following tables where the addressing spaces are divided by a double line:

| N01 | N02 | N03 | N04 | N05 | N06 | N07 | N08 | N09 | N10 | N11 | N12 |
|---|---|---|---|---|---|---|---|---|---|---|---|

| | | | | | | |
|---|---|---|---|---|---|---|
| N01 | N02 | N03 | N04 | N05 | N06 | addressing space n.1 |
| N07 | N08 | N09 | N10 | N11 | N12 | addressing space n.2 |

Case 2

In FIG. 1, the first number K is "12", the second number L is "3" and the third number M is "4"=12/3; the a first subgroup of nozzles comprises nozzles N01, N02, N03, N04; the second subgroup of nozzles comprises nozzles N05, N06, N07, N08; the third subgroup of nozzles comprises N09, N10, N11, N12; the addressing scheme according to step B is obtained by:

selecting the first address from the first space (i.e. N01), selecting the first address from the second space (i.e. N05), selecting the first address from the third space (i.e. N09), selecting the second address from the first space (i.e. N02), selecting the second address from the second space (i.e. N06), selecting the second address from the third space (i.e. N10), selecting the third address from the first space (i.e. N03), and so on till N12 when the cycle is repeated starting from address N01.

This addressing scheme can be understood better considering the following tables where the addressing spaces are divided by a double line:

| N01 | N02 | N03 | N04 | N05 | N06 | N07 | N08 | N09 | N10 | N11 | N12 |
|---|---|---|---|---|---|---|---|---|---|---|---|

| | | | | |
|---|---|---|---|---|
| N01 | N02 | N03 | N04 | addressing space n.1 |
| N05 | N06 | N07 | N08 | addressing space n.2 |
| N09 | N10 | N11 | N12 | addressing space n.3 |

Case 3

In FIG. 1, the first number K is "12", the second number L is "4" and the third number M is "3"=12/4; the a first subgroup of nozzles comprises nozzles N01, N02, N03; the second subgroup of nozzles comprises nozzles N04, N05, N06; the third subgroup of nozzles comprises N07, N08, N09; the fourth subgroup of nozzles comprises N10, N11, N12; the addressing scheme according to step is obtained by:

selecting the first address from the first space (i.e. N01), selecting the first address from the second space (i.e. N04), selecting the first address from the third space (i.e. N07), selecting the first address from the fourth space (i.e. N10), selecting the second address from the first space (i.e. N02), selecting the second address from the second space (i.e. N05), and so on till N12 when the cycle is repeated starting from address N01

This addressing scheme can be understood better considering the following tables where the addressing spaces are divided by a double line:

| N01 | N02 | N03 | N04 | N05 | N06 | N07 | N08 | N09 | N10 | N11 | N12 |
|---|---|---|---|---|---|---|---|---|---|---|---|

| | | | |
|---|---|---|---|
| N01 | N02 | N03 | addressing space n.1 |
| N04 | N05 | N06 | addressing space n.2 |
| N07 | N08 | N09 | addressing space n.3 |
| N10 | N11 | N12 | addressing space n.4 |

Case 4

In FIG. 1, the first number K is "12", the second number L is "6" and the third number M is "2"=12/2; the addressing scheme is N01, N03, N05, N07, N09, N11, N02, N04, N06, N08, N10, N12, N01, N03, . . . .

This addressing scheme can be understood better considering the following tables where the addressing spaces are divided by a double line:

| N01 | N02 | N03 | N04 | N05 | N06 | N07 | N08 | N09 | N10 | N11 | N12 |
|---|---|---|---|---|---|---|---|---|---|---|---|

| | | |
|---|---|---|
| N01 | N02 | addressing space n.1 |
| N03 | N04 | addressing space n.2 |
| N05 | N16 | addressing space n.3 |
| N07 | N08 | addressing space n.4 |
| N09 | N10 | addressing space n.5 |
| N11 | N12 | addressing space n.6 |

Case 5

In FIG. 1, the first number K is "12", the second number L is "12" and the third number M is "1"=12/12; the addressing scheme is N01, N02, N03, N04, N05, N06, N07, N08, N09, N10, N11, N12, N01, N02, . . . .

This addressing scheme can be understood better considering the following tables where the addressing spaces are divided by a double line:

| N01 | N02 | N03 | N04 | N05 | N06 | N07 | N08 | N09 | N10 | N11 | N12 |
|---|---|---|---|---|---|---|---|---|---|---|---|

| | |
|---|---|
| N01 | addressing space n.1 |
| N02 | addressing space n.2 |
| N03 | addressing space n.3 |
| N04 | addressing space n.4 |
| N05 | addressing space n.5 |
| N06 | addressing space n.6 |
| N07 | addressing space n.7 |
| N08 | addressing space n.8 |
| N09 | addressing space n.9 |
| N10 | addressing space n.10 |
| N11 | addressing space n.11 |
| N12 | addressing space n.12 |

As already said, a printhead with staggered nozzles is generally designed for a certain printing resolution, that can be called an "intrinsic resolution" and is to be considered the "standard resolution", at a certain transversal translation speed, that can be called the "reference speed" "v".

If the above defined step C is carried out while the printhead translates transversally at a speed substantially equal to the reference speed divided by the second number L, a printout at a different resolution is obtained; namely the resolution obtained corresponds to the standard resolution multiplied by a multiplying factor corresponding to the second number L.

If the standard resolution is 300 dpi and the reference speed is 1 m/s, in case 1 the resolution is 600 dpi and the speed is 0.5 m/S, in case 2 the resolution is 900 dpi and the speed is 0.333 m/s, in case 3 the resolution is 1200 dpi and the speed is 0.25 m/s, in case 4 the resolution is 1800 dpi and the speed is 0.166 m/s, in case 5 the resolution is 3600 dpi and the speed is 0.083 m/s.

It must be noted that advantageously the addressing timing may be independent from the second number L; a different (preferably, a slightly different) addressing timing might be used due to other technical reasons. With reference to the above example, this means that the same addressing timing may be used in all cases; this addressing timing may also be the same used for printing at standard resolution.

If the nozzles are staggered according to a constant pitch "p" and if the reference speed of the printhead is "v", the delay between two consecutives addressing is the quotient between the pitch "p" and the reference speed "v".

In the example of FIG. 1, for all five cases, the delay is 7 μm/1 μm/s=7 μs; therefore, every 7 μs a different nozzle is addressed and, as the nozzles are 12, each nozzle is addresses once every 12×7 μs=84 μs.

In order to reduce the print time, it is common to design printheads that print when moving transversally in both directions, e.g., from left to right and from right to left.

The method according to the present invention is adapted to this functionality: when the printhead translates transversally in a first direction, e.g. from left to right of FIG. 1, the nozzles are addressed according to the addressing scheme of step B, and when the printhead translates transversally in a second direction, which is opposite to the first direction, e.g. from right to left of FIG. 1, the nozzles are addressed according to an addressing scheme corresponding to the reverse of the addressing scheme of step B. For example, in case 4, the reversed addressing scheme is N12, N10, N08, N06, N04, N02, N11, N09, N07, N05, N03, N01.

Second Example

For the second example, the printhead is shown in FIG. 2.

The nozzles of the print group are thirteen, staggered with a pitch "p" of 5.29 μm, and arranged according to a spatial order, i.e. N01 N02 N03 N04 N05 N06 N07 N08 N09 N10 N11 N12 N13, with respect to a first transversal translation direction of the printhead, i.e. from left to right.

Number "13" can be exactly divided only by 13 and 1. Therefore, according to the teaching explained above, it would appear that, with the printhead of FIG. 2, only two resolutions would be possible: either the standard resolution of e.g. 300 dpi or a resolution of 13×300 dpi=3900 dpi.

Anyway, the present invention provides, in such a case, a trick: to apply the teaching explained above as if the printhead would be modified to have a different number of nozzles. To be more precise, this trick provides for fake addresses, i.e. addresses that may be considered to correspond to fake nozzles; anyway, fake nozzles do not need to be realized in the printhead (and preferably, as explained more in detail below, they are actually not present in the printhead), while fake addresses are used in the addressing method.

The use of fictitious nozzles is known from the prior art though for a completely different purpose. In U.S. Pat. No. 6,851,791, the groups of nozzles in a polychromatic printhead comprise real nozzles and fictitious nozzles, as a result of which the groups of nozzles have a regular layout, and are uniformly distributed and equivalent to the corresponding layout of a monochromatic printhead. With this solution, polychromatic heads having the same number and the same disposition of contacts with the external circuit and the same height as a monochromatic head can be manufactured simply. Furthermore, in the cited patent, fictitious nozzles needed to be actually realized in the printhead in order to produce heads of same dimensions.

The first thing to be done is to identify a number P greater than the number K of nozzles and having many small exact divisor.

In the example of FIG. 2, K is 13 and P could be e.g. 16 that has 2, 4, 8 and 16 as exact divisors. According to the teaching explained above, if the printhead has a print column with 16 nozzles and the standard resolution is 300 dpi, it is possible to print at 2×300=600 dpi, 4×300=1200 dpi, 8×300=2400 dpi and 16×300=4800 dpi.

The physical staggering width of the printhead is 13×5.29 μm=68.77 μm, but the modified staggering width is 16×5.29 μm=84.64 μm, corresponding to a maximum resolution of 300 dpi. In the modified printhead, three fake nozzles are added after the last nozzle of the column, i.e. N13; the label and address of these three fake nozzles are N14, N15, N16.

It is to be noted that if P would be chosen differently, e.g. 15 having as exact divisors 3 5 15, the various resolutions and the modified staggering width and the number of fake nozzles and of fake addresses would be different.

For printing at standard resolution, i.e. 300 dpi, the reference speed of e.g. 1 m/s=1 μm/μs may be used. If the pattern to be printed is a vertical line, at first nozzle N01 is addressed and fires, after 5.29 μs nozzle N02 is addressed and fires, after 5.29 μs nozzle N03 is addressed and fires, after 5.29 μs nozzle N04 is addressed and fires, after 5.29 μs nozzle N05 is addressed and fires, after 5.29 μs nozzle N06 is addressed and fires, after 5.29 μs nozzle N07 is addressed and fires, after 5.29 μs nozzle N08 is addressed and fires, after 5.29 μs nozzle N09 is addressed and fires, after 5.29 μs nozzle N10 is addressed and fires, after 5.29 μs nozzle N11 is addressed and fires, after 5.29 μs nozzle N12 is addressed and fires, after 5.29 μs nozzle N13 is addressed and fires, after 5.29 μs fake nozzle N14 is addressed and does not fire as it is fake, after 5.29 μs fake nozzle N15 is addressed and does not fire as it is fake, after 5.29 μs fake nozzle N16 is addressed and does not fire as it is fake. This means that after having generated a printed dot by means of nozzle N13 a delay of 15.87 μs passes before generating a printed dot by means of another nozzle, namely nozzle N01; in other words the vertical line is made of thirteen printed dots, each originating from a "real" nozzle.

For printing at double resolution, i.e. 600 dpi, the transversal translation speed of the printhead has to be halved, i.e. 0.5 μm/μs=0.5 m/s. If patterns to be printed are vertical lines, at first nozzle N01 is addressed and fires, after 5.29 μs nozzle N09 is addressed and fires, after 5.29 μs nozzle N02 is addressed and fires, after 5.29 μs nozzle N10 is addressed and fires, after 5.29 μs nozzle N03 is addressed and fires, after 5.29 μs nozzle N11 is addressed and fires, after 5.29 μs nozzle N04 is addressed and fires, after 5.29 μs nozzle N12 is addressed and fires, after 5.29 μs nozzle N05 is addressed and fires, after 5.29 μs nozzle N13 is addressed and fires, after 5.29 μs nozzle N06 is addressed and fires, after 5.29 μs fake nozzle N14 is addressed and does not fire as it is fake, after 5.29 μs nozzle N07 is addressed and fires, after 5.29 μs fake nozzle N15 is addressed and does not fire as it is fake, after 5.29 μs nozzle N08 is addressed and fires, after 5.29 μs fake nozzle N16 is addressed and does not fire as it is fake.

It is apparent that with the described sequence, two pattern sections belonging respectively to two different patterns are printed on the print medium. Anyway, the top printed pattern is made of eight dots respectively generated by nozzles N01 N02 N03 N04 N05 N06 N07 N08, while the bottom printed pattern is made of five dots respectively generated by N09 N10 N11 N12 N13; the distance between the two pattern sections is about 42 μm (actually about 38.5 μm) corresponding to a resolution of 600 dpi, as desired.

After that, the printhead is ready to print two new pattern sections respectively at a distance of about 42 μm from the already printed pattern sections, corresponding to a resolution of 600 dpi, as desired.

The present invention may be defined in broader terms even when the above mentioned trick is used.

In general, considering a group of nozzles of a printhead (typically a print group in a print column) comprising a first number K of nozzles arranged according to a spatial order along a transverse direction, the method according to the present invention comprises the steps of:

A) dividing the group of nozzles into a second number L of sequential subgroups of nozzles, corresponding to a second number L of addressing spaces, said addressing spaces consisting of a same third number M of addresses, wherein the first of said addressing spaces comprises the address of the first nozzle in said spatial order, B) preparing an addressing scheme by cyclically and progressively selecting addresses from said addressing spaces, starting from the address corresponding to the first nozzle in said spatial order and following a spatial order with respect to the transverse direction, C) when the printhead translates transversally along said direction, addressing the nozzles of the group according to the addressing scheme of step B;

the first number K, the second number L and the third number M are integers, the second number L is not greater than the first number K, and the third number M is the integer immediately greater than the quotient between the first number K and the second number L.

Considering the printhead of FIG. 2, K is 13. If L is chosen equal to 2 (e.g., the printing resolution desired is twice the standard resolution), M is the integer immediately greater than 13/2=6.5, i.e. 7. If L is chosen equal to 3, M is the integer immediately greater than 13/3=4.33, i.e. 5. If L is chosen equal to 4, M is the integer immediately greater than 13/4=3.25, i.e. 4. If L is chosen equal to 5, M is the integer immediately greater than 13/5=2.6, i.e. 3.

As the remainder of the division of the first number K by the second number L is not zero, i.e. the second number L is not an exact divisor of the first number K, one or more fake addresses (that do not corresponds to physical nozzles of the printhead) have to be added in at least one addressing space.

Preferably, all the fake addresses are added to the last addressing space so that no substantial print distortion results.

The number of fake addresses corresponds to the remainder of the subtraction of the first number K from the multiplication of the second number K by the third number M.

If K=13, L=2, M=7, the number of fake addresses is 2×7−13=1.

If K=13, L=3, M=5, the number of fake addresses is 3×5−13=2.

If K=13, L=4, M=4, the number of fake addresses is 4×4−13=3.

If K=13, L=5, M=3, the number of fake addresses is 5×3−13=2.

Preferably, all said fake-addresses are added in the last addressing space after the address of the last nozzle in said spatial order so that no print distortion results.

If the second number L is relatively large with respect to the first number K, one or more addressing spaces may consist of fake addresses only and one addressing space may comprise one or more real addresses and one or more fake addresses.

For example, if the printhead provided with 13 nozzles (K=13) of FIG. 2 is used and L is 8, M is the integer immediately greater than 13/8=1.625, i.e. 2, and the number of fake addresses is 8×2−13=3; fake addresses are N14, N15, N16; in this case, the first addressing space consists of N01 and N02, the second addressing space consists of N03 and N04, the third addressing space consists of N05 and N06, the fourth addressing space consists of N07 and N08, the fifth addressing space consists of N09 and N10, the sixth addressing space consists of N11 and N12, the seventh addressing space consists of N13 and N14 (one is a real address and the other is a fake address), the eighth addressing space consists of N15 and N16 (both are fake addresses).

As it is clear from the above description, the method according to the present invention is identically applied whether or not the second number L is an exact divisor of the first number K, provided that an appropriate number of fake nozzles is added after the last real nozzle of the print group in the print column of the printhead.

Evidently, the same considerations regarding the translation speed and direction of the printhead and the addressing timing used for nozzles (both real and fake) made in case of exact division applies to non-exact division.

It has to be noted that, if the printhead of FIG. 2 would be used for printing at a resolution being 13 times the standard resolution, no fake addresses would be necessary.

In general, with the same printhead different addressing methods according to the present invention may be used according to the number of fake addresses added. For example, with the printhead of FIG. 2 where the print group is made of thirteen nozzles, if two fake addresses are added multiples 3 and 5 can be obtained, and if three fake addresses are added multiples 2 and 4 and 8 can be obtained; anyway, as the pitch remains the same, a certain small print error may be introduced unless a different addressing timing are used for the two cases.

In the two examples described above, the nozzles are arranged according to the same spatial order both in the transversal direction and in the longitudinal direction. Anyway, this is not a requirement of the present invention.

Figures 3, 4, 5:
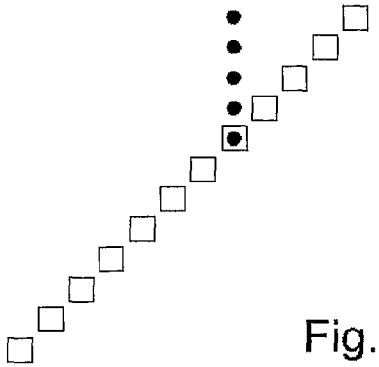
FIG. 5 shows the layout of the nozzles of a group in a third printhead.

The addressing method according to the present invention mat be applied for example to the printhead of FIG. 5 where the spatial order in the transversal direction is N01, N02, N03, N04, N05, N06, N07, N08, N09, N10, N11, N12 while the spatial order in the longitudinal direction is N01, N04, N07, N10, N02, N05, N08, N11, N03, N06, N09, N12. Such a layout is useful for having a bigger distance between the nozzles successively firing and therefore lowers the risk of interference between adjacent nozzles.

The nozzles of the print group of the print column of the printhead of FIG. 5 are twelve and may be addressed with an addressing scheme identical to the one used for the nozzles of the print group of the print column of the printhead of FIG. 1. At standard resolution, the nozzles will be addressed according to their spatial order in the transversal direction, i.e. N01, N02, N03, N04, N05, N06, N07, N08, N09, N10, N11, N12. At double resolution, the nozzles will be addressed according to the following order N01, N07, N02, N08, N03, N09, N04, N10, N05, N11, N06, N12. At double resolution, in one print phase, both the printhead of FIG. 1 and the printhead of FIG. 5 prints two pattern sections (of two print patterns) displaced from one another. For the printhead of FIG. 1, both pattern sections are made of adjacent dots, whereas for the printhead of FIG. 5 both pattern sections are made of non-adjacent dots. For example, if the two patterns are vertical lines, after one print phase, with the printhead of FIG. 1 two short vertical segments are obtained while with the printhead of FIG. 5 twelve doubly aligned dots are obtained.

From the above, it is clear that the present invention considers only the transversal positions of the nozzles and not the longitudinal positions of the nozzles; therefore, all the examples of the present invention described till now and all the definitions of the present invention set out till now are fully valid independently from the longitudinal positions of the nozzles in the printhead.

The addressing method of the present invention may be applied to any staggered nozzles printhead independently of its number of nozzles, its pitch and its layout. This is an important advantage of the present invention, as designing a devices incorporating the elements ejecting ink drops (usually "chips", i.e. integrated circuits) is expensive and time consuming; therefore, it is useful to enable the use of an already available printhead for a new product with improved performances.

Figures 3, 4, 5, 6:
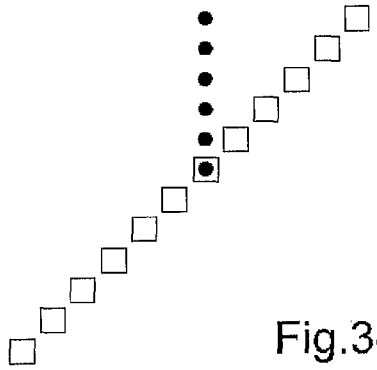
FIG. 6 shows a much simplified block diagram of a printing system.
Figures 3, 4, 5, 6, 7:
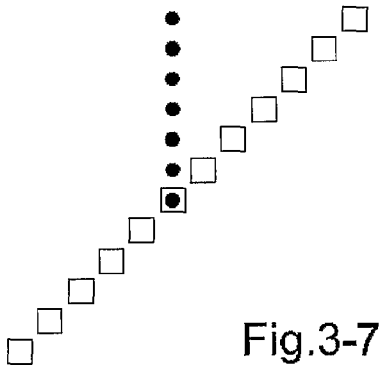
Figures 3, 4, 5, 6, 7, 8:
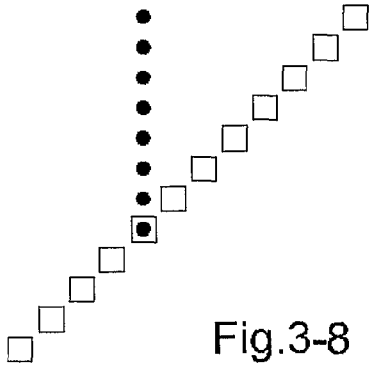
Figures 3, 4, 5, 6, 7, 8, 9:
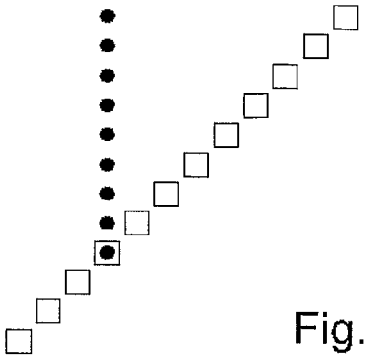
Figures 3, 4, 5, 6, 7, 8, 9, 10:
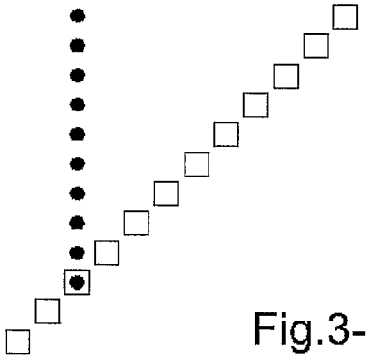
Figures 3, 4, 5, 6, 7, 8, 9, 10, 11:
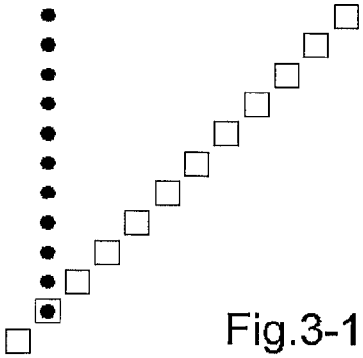
Figures 3, 4, 5, 6, 7, 8, 9, 10, 11, 12:
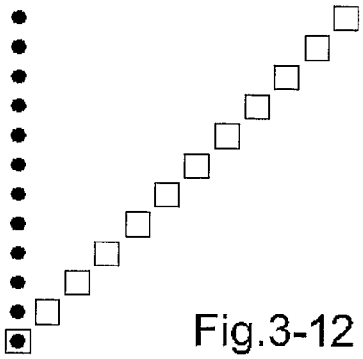
Figures 3, 4, 5, 6, 7, 8, 9, 10, 11, 12, 13:
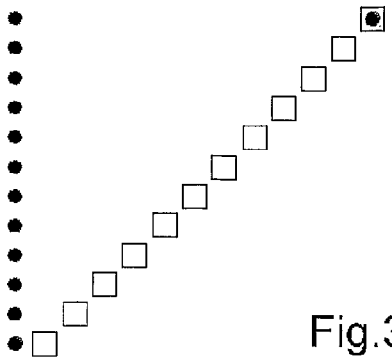
Figures 3, 4, 5, 6, 7, 8, 9, 10, 11, 12, 13, 14:
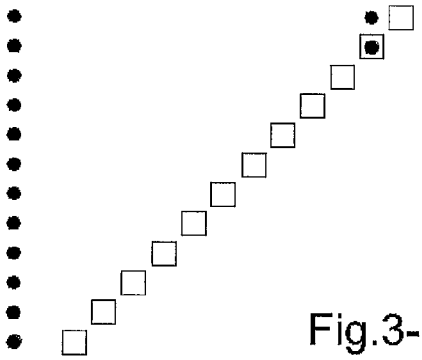
Figures 3, 4, 5, 6, 7, 8, 9, 10, 11, 12, 13, 14, 15:
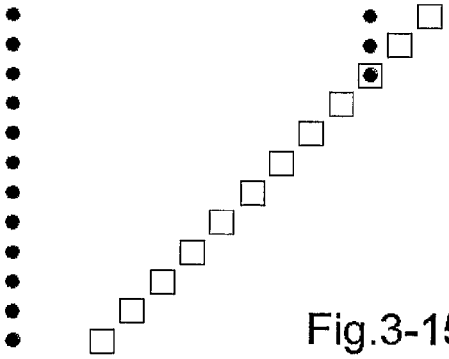
Figures 3, 4, 5, 6, 7, 8, 9, 10, 11, 12, 13, 14, 15, 16:
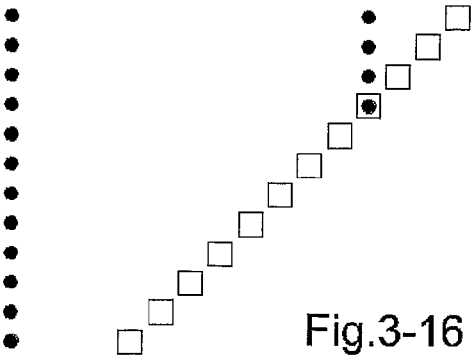
Figures 1, 4:
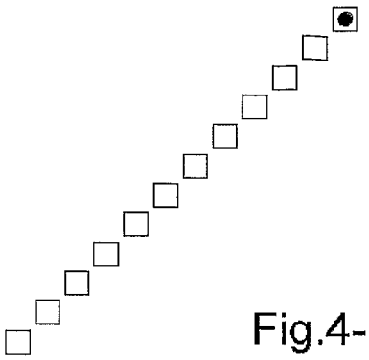
Figures 2, 4:
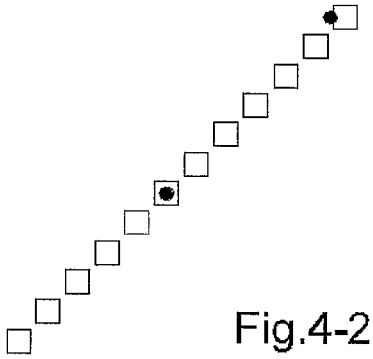
Figures 3, 4:
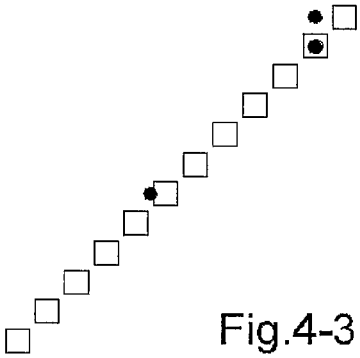
Figure 4:
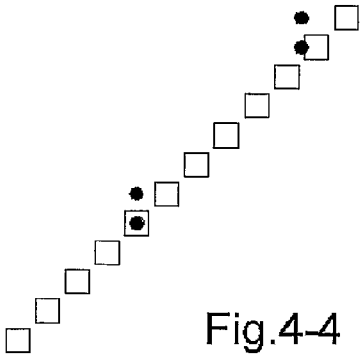
Figures 4, 5:
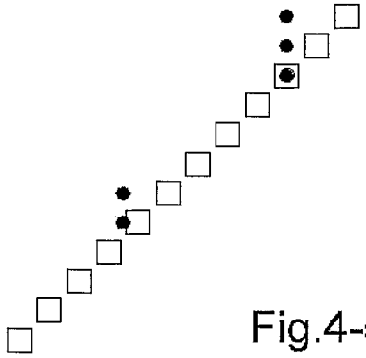
Figures 4, 5, 6:
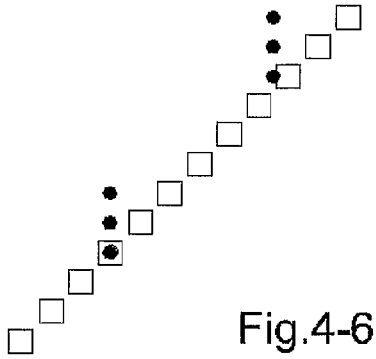
Figures 4, 5, 6, 7:
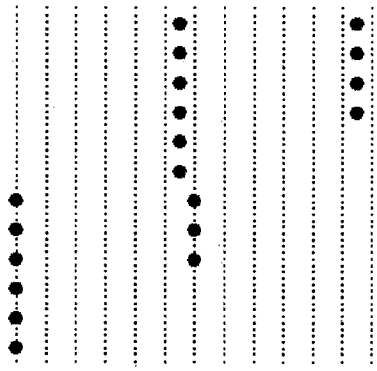
Figure 5:
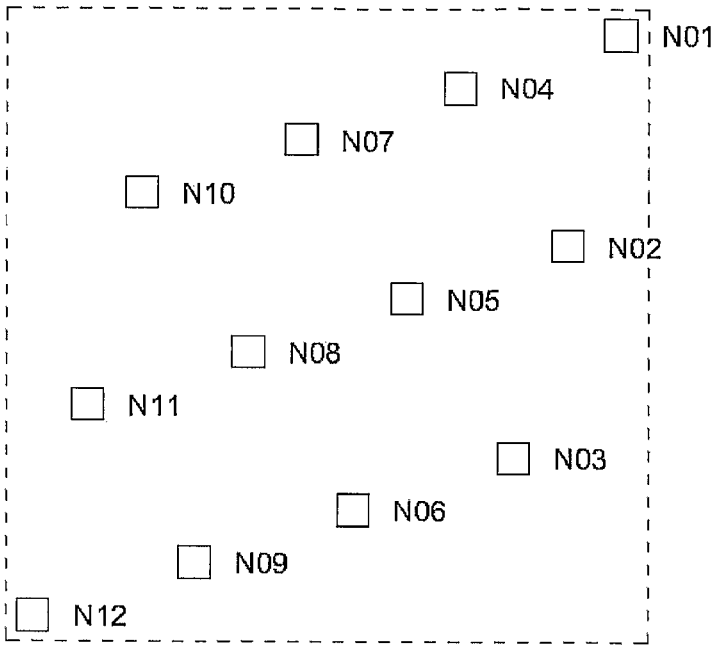
Figure 6:
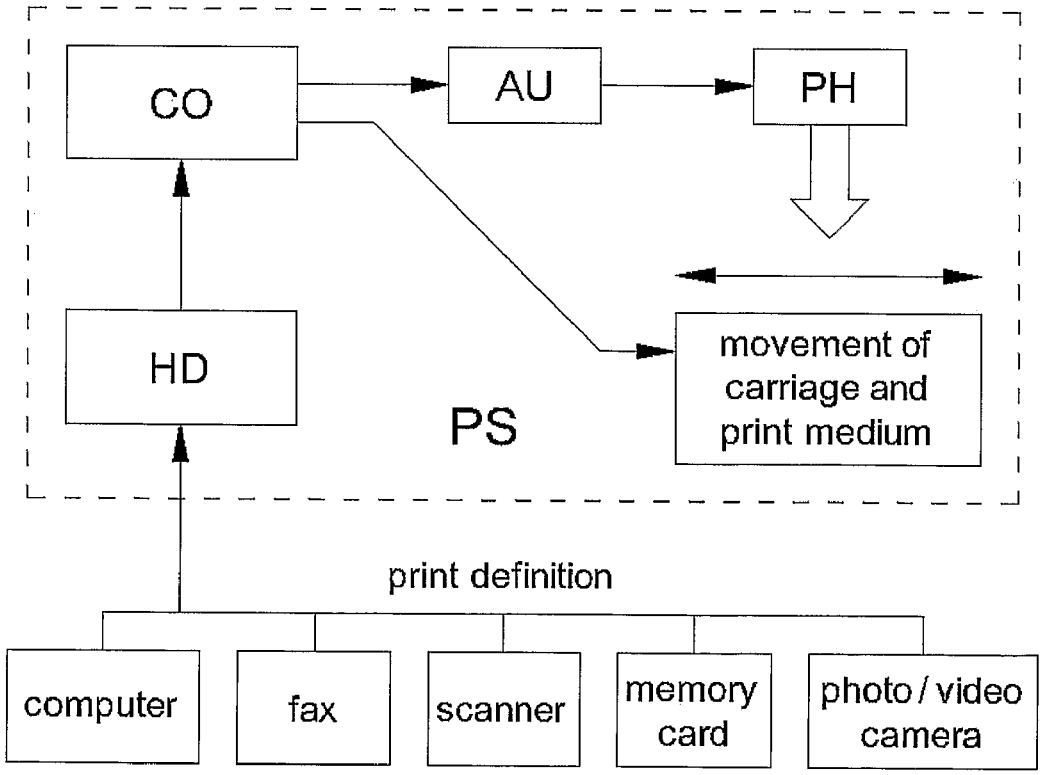

Further aspects of the present invention can be better understood referring to FIG. 6.

FIG. 6 shows a simplified block diagram of a printing system PS.

Printing system PS may be a printer or, for example, an electronic apparatus integrating a printer with a scanner machine and/or a fax machine and/or a copy machine. The printing system PS can be connected to a computer at least for receiving the data (text and/or images) to be printed out. In addition to or in alternative to this computer connection, printing system PS may receive data from e.g., a scanner machine, a photo camera machine, a video camera machine, a memory card, a computer network, or a telephone line. In FIG. 6, some of the possible peripheral machines connectable to the PS are shown.

Printing system PS comprises a controller CO for controlling at least the printing process of the system; additionally, printing system PS comprises a printhead PH. Although not shown in FIG. 6, the printhead PH is typically included in a print cartridge comprising an ink reservoir for supplying ink to the vaporization chambers provided in the printhead (details of the print cartridge are known in the art and they will not be hereafter further specified). Printhead PH is provided with a plurality of print nozzles (not shown in FIG. 6).

The system structure shown in FIG. 6 is generally known. Printing system PS includes a head driver HD, which is typically a software component resident for example in the printer or in a personal computer connected to the printer. Head driver HD receives input information, in particular but not limited to, the desired print definition, from the peripheral machines or from the printer self, transforms the documents or images to be printed in a format suitable to be printed as dots (e.g., by transforming the documents or images by means of a dithering process known per se) and then sends the data and the commands to the controller CO. The controller CO is configured to provide control signals, which control the movements of the carriage on which the printhead is mounted and of the print medium. The control signals generated by controller CO are sent to the addressing unit AU comprising a processor, which electrically addresses the thermal ejectors and therefore causes the respective nozzles to fire.

As far as the present invention is concerned, such a printing system comprises a printhead provided with a plurality of staggered printing nozzles and a processor adapted to carry out the addressing method according to what described above. Said processor is preferably, but not necessarily, provided in the controller CO of the printing system PS described with reference to FIG. 6. More in general, the printing process, including the preparation of the addressing scheme and the addressing of the nozzles, of the printhead can be carried through different components variously distributed in the printing system. To a certain extent, the printing process may be carried out e.g. in a computer connected to the printing system by a software head driver executed by the computer. Obviously, other components may be (and usually are) comprised in such a printing system PS, for example a memory for storing data to be printed; this memory may store a program to be executed by the processor for carrying out the addressing method.

The present invention aims at providing an efficient and effective way to print at high resolutions, higher than the standard resolution of the printhead.

Anyway, it is useful that a printer prints at least one resolution lower than the standard resolution, usually called draft resolution, and at a speed higher than the standard resolution.

As explained with regard to the first example, in order to prevent or minimize misalignment of the printed dots in the printing line(s) in quick low-resolution printing, the sum of duration of the firing pulses of the nozzles should preferably have short firing pulse duration.

Furthermore, once the standard resolution has been chosen, it is advantageous to stagger the nozzles within the maximum (or almost maximum) staggering width compatible with the chosen standard resolution. For example, if a standard resolution of 300 dpi, the maximum staggering width is 25400 μm/300 dpi=84.66 μm; and the nozzles can be staggered within 84.66 μm or slightly less, e.g. 84 μm. In case of e.g. 12 nozzles, the maximum pitch would about 84 μm/12=about 7 μm. In this way, at the standard resolution, the nozzles fire with maximum possible firing delay, i.e., the time elapsed between subsequent firing pulses is maximum, thereby making less challenging to decrease the delay when printing at draft resolution.

If it is possible to freely choose the number of nozzles in the print group, an advantageous number would be e.g. "24" as it has many exact divisors, including many small ones, i.e. 2 3 4 6 8 12 16 24. Possible alternative numbers would be e.g. 20 or 21 or 22 or 23 that are next to 24; a limited number of fake nozzles would be necessary for applying the method according to the present invention.

If it is possible to choose freely the position of the nozzles, it would be possible to compensate for the misalignment error previously mentioned.

In general, if the nozzles are shifted from the theoretical positions within the distribution of staggering there would be an error both at standard resolution and equal error at the highest resolution; therefore, the user of the printer would be not appreciate any substantial print difference between the various resolutions.

As far as the print definition is concerned, the print process preferably follows the following steps:

deciding the resolution type, i.e. draft, standard, high,
determining the firing spatial step,
determining the transversal translation speed,
determining the nozzle addressing scheme,
determining the addressing timing.

For standard resolution:

the firing spatial step is the nominal one,
the transversal translation speed is the nominal one,
the nozzle addressing scheme is the nominal one,
the addressing timing is the nominal one.

For draft resolution:

the firing spatial step is the double of the nominal one,
the transversal translation speed is the double the nominal one,
the nozzle addressing scheme is the nominal one, the addressing timing is the half of the nominal one.

For high resolution:

the multiplying resolution factor X is determined, the firing spatial step is the nominal one divided by X, the transversal translation speed is the nominal one divided by X, the nozzle addressing scheme is determined according to the present invention taking X into account, the addressing timing is the nominal one.

The invention claimed is:

1. A method of addressing a group of a first number (K) of nozzles of a printhead, the nozzles of said group being staggered and being arranged according to a spatial order with respect to a first transversal translation direction of the printhead, each nozzle of said group having an own unique address, comprising:

A) dividing said group of nozzles into a second number (L) of sequential subgroups of nozzles, corresponding to a second number (L) of addressing spaces, said addressing spaces consisting of a same third number (M) of addresses, wherein the first of said addressing spaces comprises the address of the first nozzle in said spatial order, B) preparing an addressing scheme by cyclically and progressively selecting addresses from said addressing spaces, starting from the address corresponding to the first nozzle in said spatial order and following said spatial order, C) when said printhead translates transversally along said first transversal direction, addressing the nozzles of said group according to the addressing scheme of step B;

wherein said first number (K), said second number (L) and said third number (M) are integers, wherein said second number (L) is not greater than said first number (K), wherein said third number (M) is the integer equal to or immediately greater than the quotient between said first number and said second number, and wherein the last addressing space of said addressing spaces comprises at least one fake address that does not correspond to a nozzle of said group if the remainder of the division of said first number (K) by said second number (L) is not zero.

2. The addressing method according to claim 1, wherein the number of fake addresses corresponds to the remainder of the subtraction of said first number (K) from the multiplication of said second number (L) by said third number (M).

3. The addressing method according to claim 1, wherein all said fake addresses are added in the last addressing space after the address of the last nozzle in said spatial order.

4. The addressing method according to claim 1, wherein in step C said printhead translates transversally at a speed substantially equal to a reference speed divided by said second number (L).

5. The addressing method according to claim 4, wherein the reference speed is the translation speed of said printhead for printing at standard resolution.

6. The addressing method according to claim 1, wherein the timing employed to carry out the addressing scheme of step B is independent from said second number (L).

7. The addressing method according to claim 6, wherein the nozzles of said group are staggered according to a constant pitch, wherein a delay between two successive addresses is the quotient between said pitch and a reference speed.

8. The addressing method according to claim 7, wherein said reference speed is the translation speed of said printhead for printing at standard resolution.

9. The addressing method according to claim 1, wherein, when said printhead translates transversally in a second transversal direction opposite to said first transversal direction, the nozzles of said group are addressed according to an addressing scheme corresponding to the reverse of the addressing scheme of step B.

10. The addressing method according to claim 1, wherein said second number (L) corresponds to a multiplying factor of the standard resolution of said printhead.

11. A printhead comprising a plurality of staggered printing nozzles and a processor adapted to carry out the addressing method according to claim 1.

12. The printhead according to claim 11, wherein the said plurality of nozzles are apt to produce at least one print column and are staggered within a staggering width, the standard resolution of the printhead corresponding approximately to said staggering width.

13. The printhead according to claim 12, wherein said plurality of nozzles are staggered according to a uniform pitch.

14. The printhead according to claim 12, wherein the standard resolution of the printhead corresponds to said staggering width.

15. A printing system comprising the printhead according to claim 11.

16. A printing system comprising a printhead with a plurality of staggered printing nozzles and a processor adapted to carry out the addressing method according to claim 1.

* * * * *